US007947217B2

(12) United States Patent
Goodman et al.

(10) Patent No.: US 7,947,217 B2
(45) Date of Patent: May 24, 2011

(54) METALLURGICAL PROCESSING INSTALLATION

(75) Inventors: Neil John Goodman, Mt Pleasant (AU); Philip James Ions, Shelley (AU); Ian William Beaumont, Shelley (AU); Stephen Prendergast, Mt Claremont (AU)

(73) Assignee: Technological Resources Pty. Limited, Melbourne (AU)

( * ) Notice: Subject to any disclaimer, the term of this patent is extended or adjusted under 35 U.S.C. 154(b) by 857 days.

(21) Appl. No.: 11/587,642

(22) PCT Filed: Apr. 22, 2005

(86) PCT No.: PCT/AU2005/000576

§ 371 (c)(1),
(2), (4) Date: Aug. 21, 2007

(87) PCT Pub. No.: WO2005/103305

PCT Pub. Date: Nov. 3, 2005

(65) Prior Publication Data

US 2007/0290419 A1 Dec. 20, 2007

(30) Foreign Application Priority Data

Apr. 26, 2004 (AU) ..... 2004902164
Oct. 8, 2004 (AU) ..... 2004905848

(51) Int. Cl.
*C21C 1/00* (2006.01)

(52) U.S. Cl. ..... 266/193; 266/241

(58) Field of Classification Search ..... 266/193, 266/194, 241
See application file for complete search history.

(56) References Cited

U.S. PATENT DOCUMENTS

| | | | | |
|---|---|---|---|---|
| 3,586,304 | A | 6/1971 | Greaves et al. | |
| 3,719,355 | A * | 3/1973 | Suette et al. | 266/241 |
| 6,267,799 | B1 | 7/2001 | Innes et al. | |
| 6,322,745 | B1 * | 11/2001 | Leigh et al. | 266/44 |
| 6,398,842 | B2 | 6/2002 | Dunne | |
| 6,440,356 | B2 | 8/2002 | Dunne | |
| 6,565,798 | B2 | 5/2003 | Gurr et al. | |
| 6,773,659 | B2 | 8/2004 | Dunne et al. | |
| 2003/0011114 | A1 | 1/2003 | Dunne | |

FOREIGN PATENT DOCUMENTS

| | | |
|---|---|---|
| EP | 1 067 201 A2 | 1/2001 |
| EP | 1 120 618 A2 | 8/2001 |

(Continued)

*Primary Examiner* — Scott Kastler
(74) *Attorney, Agent, or Firm* — Finnegan, Henderson, Farabow, Garrett & Dunner, L.L.P.

(57) ABSTRACT

Metallurgical processing installation comprising a metallurgical vessel lined internally with water cooled panels. A vessel access tower (61) fits around vessel (11) and supports a coolant flow system (62) to provide for flow of cooling water to and from the cooling panels within the vessel through water inlet and outlet connections (42,43) distributed around the exterior of the vessel. Coolant flow system (62) includes large diameter water supply and return pipes (66,67) mounted on an upper part of the tower (61) to extend around the upper end of vessel (11), a first series of vertical dropper pipes (68) of relatively small diameter connected to the main water supply pipe 66 and extending downwardly to connections with the water inlet connectors for respecting cooling panels of the vessel and a second series of smaller diameter vertical pipes (69) connected at their upper ends to the main return pipe (67) and at their lower ends to undivided outlet connectors for the cooling panels in the vessel.

26 Claims, 14 Drawing Sheets

FOREIGN PATENT DOCUMENTS

| | | | |
|---|---|---|---|
| EP | 1 067 201 | A3 | 4/2002 |
| EP | 1 120 618 | A3 | 12/2003 |
| EP | 1 120 618 | B1 | 7/2006 |
| EP | 1 067 201 | B1 | 10/2006 |
| GB | 2 170 890 | A | 8/1986 |
| JP | 59064708 | | 12/1984 |
| JP | 1127613 | | 12/1989 |
| JP | 3065598 | | 12/2000 |
| SU | 859457 | | 8/1981 |
| WO | WO 94/19497 | | 9/1994 |
| WO | WO 96/31627 | | 10/1996 |
| WO | WO 99/20966 | | 4/1999 |
| WO | WO 00/01854 | | 1/2000 |
| WO | WO 01/81637 | A1 | 11/2001 |
| WO | WO 2004/090173 | A1 | 10/2004 |

* cited by examiner

METALLURGICAL PROCESSING INSTALLATION

TECHNICAL FIELD

The present invention relates to metallurgical processing installations in which metallurgical processes are performed within metallurgical vessels. The invention has particular but not exclusive application to installations used for performing direct smelting to produce molten metal in pure or alloy form from a metalliferous feed material such as ores, partly reduced ores and metal-containing waste streams.

A known direct smelting process, which relies principally on a molten metal layer as a reaction medium, and is generally referred to as the HIsmelt process, is described in U.S. Pat. No. 6,267,799 and International Patent Publication WO 96/31627 in the name of the applicant. The HIsmelt process as described in these publications comprises:

(a) forming a bath of molten iron and slag in a vessel;

(b) injecting into the bath:

(i) a metalliferous feed material, typically metal oxides; and (ii) a solid carbonaceous material, typically coal, which acts as a reductant of the metal oxides and a source of energy; and (c) smelting metalliferous feed material to metal in the metal layer.

The term "smelting" is herein understood to mean thermal processing wherein chemical reactions that reduce metal oxides take place to produce liquid metal.

The HIsmelt process also comprises post-combusting reaction gases, such as CO and $H_2$ released from the bath, in the space above the bath with oxygen-containing gas and transferring the heat generated by the post-combustion to the bath to contribute to the thermal energy required to smelt the metalliferous feed materials.

The HIsmelt process also comprises forming a transition zone above the nominal quiescent surface of the bath in which there is a favourable mass of ascending and thereafter descending droplets or splashes or streams of molten metal and/or slag which provide an effective medium to transfer to the bath the thermal energy generated by post-combusting reaction gases above the bath.

In the HIsmelt process the metalliferous feed material and solid carbonaceous material is injected into the metal layer through a number of lances/tuyeres which are inclined to the vertical so as to extend downwardly and inwardly through the side wall of the smelting vessel and into the lower region of the vessel so as to deliver the solids material into the metal layer in the bottom of the vessel. To promote the post combustion of reaction gases in the upper part of the vessel, a blast of hot air, which may be oxygen enriched, is injected into the upper region of the vessel through the downwardly extending hot air injection lance. Off gases resulting from the post-combustion of reaction gases in the vessel are taken away from the upper part of the vessel through an offgas duct.

The HIsmelt process enables large quantities of molten metal to be produced by direct smelting in a single compact vessel. This vessel must function as a pressure vessel containing solids, liquids and gases at very high temperatures throughout a smelting operation which can be extended over a long period. As described in U.S. Pat. No. 6,322,745 and International Patent Publication WO 00/01854 in the name of the applicant the vessel may consist of a steel shell with a hearth contained therein formed of refractory material having a base and sides in contact with at least the molten metal and side walls extending upwardly from the sides of the hearth that are in contact with the slag layer and the gas continuous space above, with at least part of those side walls consisting of water cooled panels. Such panels may be of a double serpentine shape with rammed or gunned refractory interspersed between. Other metallurgical vessels have been provided with internal refractories and refractory cooling systems. In a conventional iron making blast furnace for example, the cooling system generally comprises a series of cooling staves of robust cast iron construction capable of withstanding the forces generated by the large quantities of burden extending upwardly through the column of the blast furnace. These staves are only replaced during a reline, during which the blast furnace shuts down for an extended period. These days the period between relines for a blast furnace which operates continuously can be over twenty years and a reline extends over a number of months.

Electric arc furnaces, such as those used for the batch production of steel on the other hand, may employ cooling panels which are simply suspended from a support cage which can be accessed when the lid is removed and are treated almost like consumables. They can be replaced and/or repaired during other scheduled down times or between heats.

The metallurgical vessel for performing the HIsmelt process presents unique problems in that the process operates continuously, and the vessel must be closed up as a pressure vessel for long periods, typically of the order of a year or more and then must be quickly relined in a short period of time as described in U.S. Pat. No. 6,565,798 in the name of the applicant. This requires the installation of internal cooling panels in an area to which there is limited access and a coolant flow system which enables controlled flow of coolant to and from the individual panels.

DISCLOSURE OF THE INVENTION

The invention provides a metallurgical processing installation comprising:

(a) a hollow metallurgical vessel;

(b) a plurality of cooling panels forming an internal lining for at least an upper part of the vessel, each panel having an internal passage for flow of coolant therethrough;

(c) coolant inlet and outlet connectors for the panels at locations distributed around the exterior of the vessel; and (d) a coolant flow system for flow of coolant to and from the panel inlet and outlet connectors, which flow system comprises a supply pipe and a return pipe extending generally horizontally at least partially around the vessel, a first series of upright smaller pipes connected to the main supply pipe and to the panel inlet connectors and a second series of upright pipes connected to the return pipe and to the panel outlet connectors.

The coolant flow system may be supported on a tower structure at least partially surrounding the vessel.

The tower structure may be comprised of a structural frame work of interconnecting columns and beams and it may have walkways for access to the vessel and/or the coolant flow system.

The main coolant supply pipe and the return pipe may both be supported on an upper part of the tower structure and the first and second series of smaller cross section pipes may extend downwardly therefrom.

The supply pipe and return pipe may each be of generally U-shaped configuration and disposed generally about an upper end of the vessel.

The first and second series of upright pipes may be connected to the panel inlet and outlet connectors via respective individual inlet and outlet valves allowing for adjustment of the coolant flow to and from the panels individually.

The connections to the panel inlet and outlet connectors may be made by flexible couplings.

The metallurgical vessel may be fitted with a hot gas injection lance for injecting hot gas downwardly in to an upper part of the vessel, which lance is provided with coolant flow passages, and the tower structure may also support a gas lance coolant flow system for flow of coolant to and from the coolant flow passages of the hot gas injection lance.

The metallurgical vessel may also be fitted with a series of solids injection lances for injection of solids into a lower part of the vessel, which lances are provided with coolant flow passages, and the tower structure may also support a solids lance coolant flow system for flow coolant to and from the coolant flow passages of the solids injection lances.

BRIEF DESCRIPTION OF THE DRAWINGS

In order that the invention may be more fully explained, one particular embodiment will be described in some detail with reference to the accompanying drawings in which.

DETAILED DESCRIPTION OF THE PREFERRED EMBODIMENT

Figure 1:
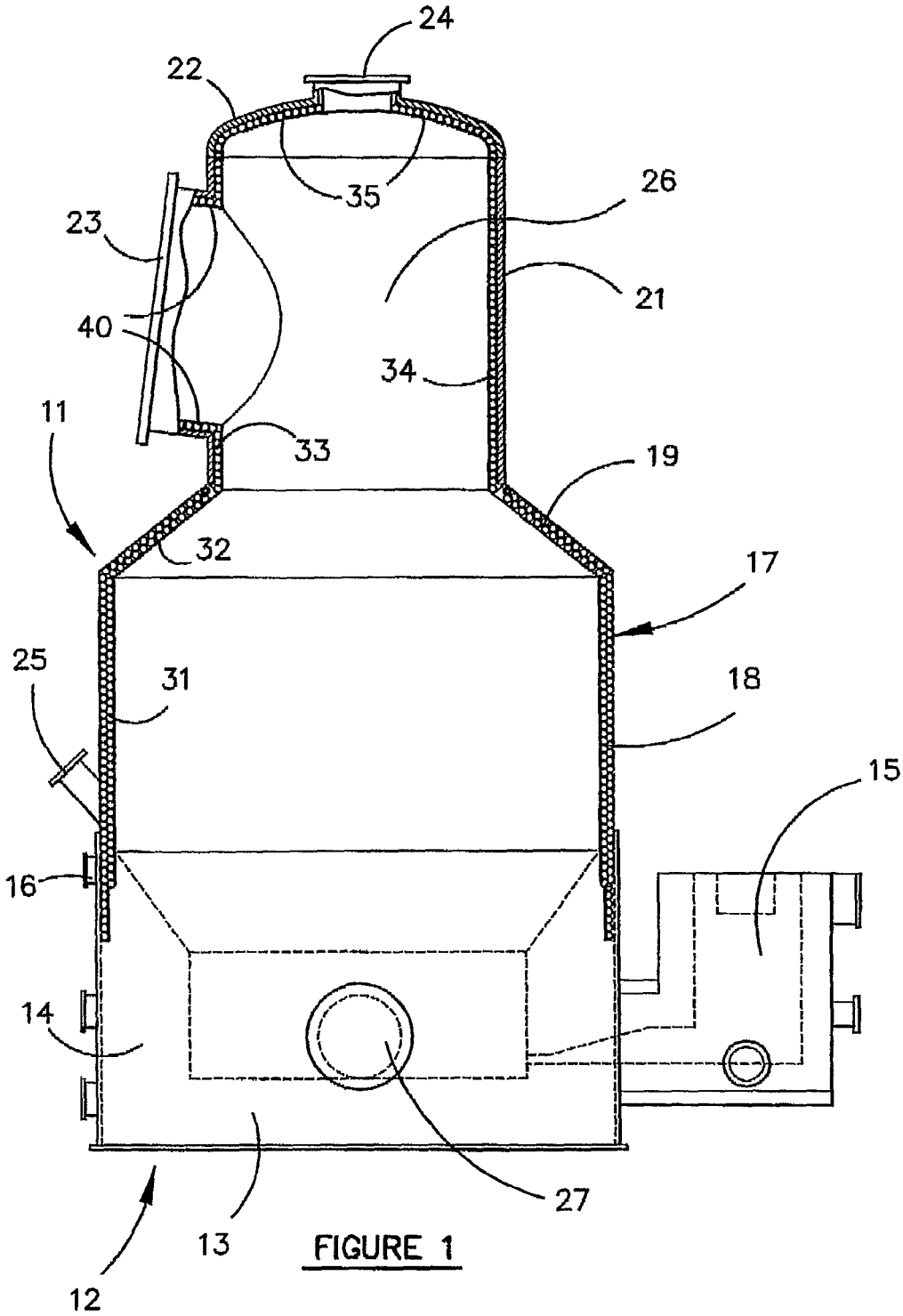
FIG. 1 is a vertical cross-section through a direct smelting vessel provided with internal cooling panels.
Figure 2:
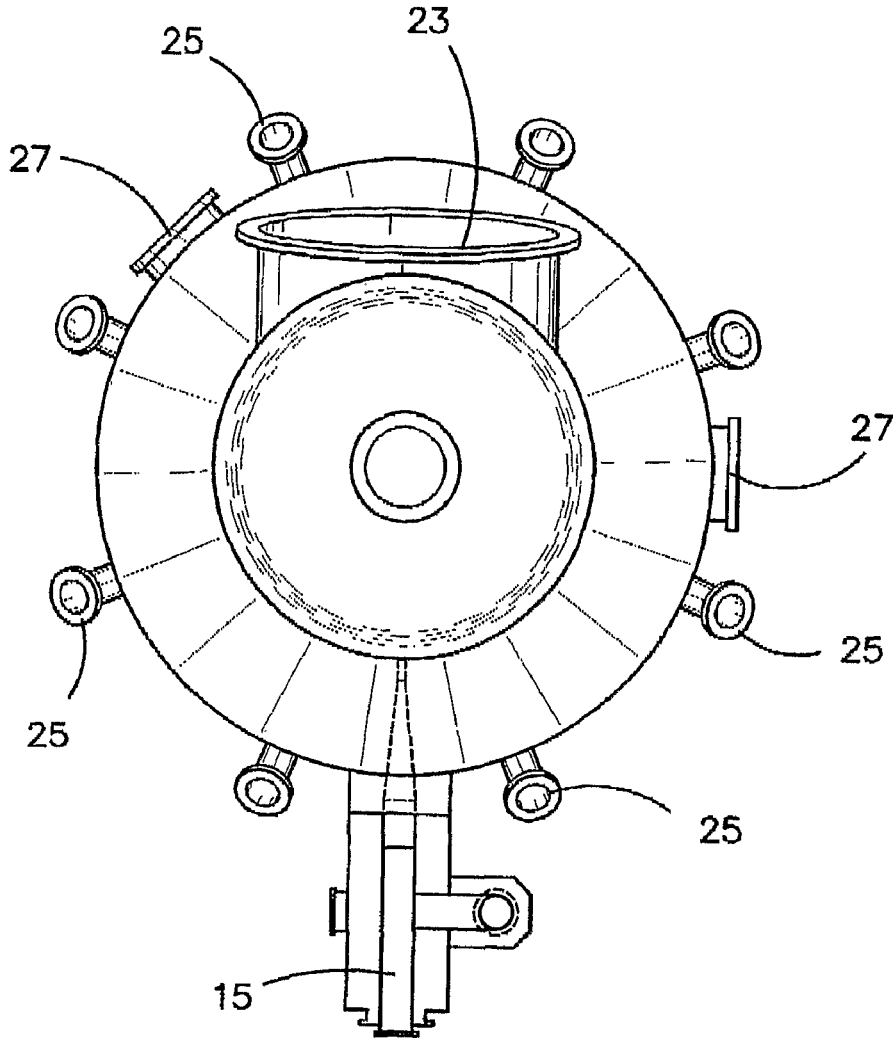
FIG. 2 is a plan view of the vessel shown in FIG. 1.

FIGS. 1 and 2 illustrate a direct smelting vessel suitable for operation of the HIsmelt process as described in U.S. Pat. No. 6,267,799 and International Patent Publication WO 96/31627. The metallurgical vessel is denoted generally as 11 and has a hearth 12 which includes a base 13 and sides 14 formed of refractory bricks, a forehearth 15 for discharging molten metal continuously and a tap hole 16 for discharging molten slag.

The base of the vessel is fixed to the bottom end of an outer vessel shell 17 made of steel and comprising a cylindrical main barrel section 18, an upwardly and inwardly tapering roof section 19, and an upper cylindrical section 21 and lid section 22 defining an offgas chamber 26. Upper cylindrical section 21 is provided with a large diameter outlet 23 for offgases and the lid 22 has an opening 24 in which to mount a downwardly extending gas injection lance for delivering a hot air blast into the upper region of the vessel. The hot gas injection lance is internally water cooled, being provided with inner and outer annular coolant flow passages for inward and outward flow of cooling water. More particularly, this lance may be of the general construction disclosed in U.S. Pat. No. 6,440,356.

The main cylindrical section 18 of the shell has eight circumferentially spaced tubular mountings 25 through which to extend solids injection lances for injecting iron ore, carbonaceous material, and fluxes into the bottom part of the vessel. The solids injection lances are also internally water cooled, being provided with inner and outer annular coolant flow passages for inward and return flows of cooling water. More particularly, the solids injection lances may be of the general construction disclosed in U.S. Pat. No. 6,398,842.

In use the vessel contains a molten bath of iron and slag and the upper part of the vessel must contain hot gases under high pressure and extremely high temperatures of the order of 1200° C. The vessel is therefore required to operate as a pressure vessel over long periods and it must be of robust construction and completely sealed. Access to the interior of the vessel is extremely limited, access essentially being limited on shut down through lid opening 24 and reline access doors 27.

Vessel shell 11 is internally lined with a set of 107 individual cooling panels through which cooling water can be circulated and these cooling panels are encased in refractory material to provide a water cooled internal refractory lining for the vessel above the smelting zone. It is important that the refractory lining be virtually continuous and that all of the refractory material be subject to cooling as uncooled refractory will be rapidly eroded. The panels are formed and attached to the shell in such a way that they can be installed internally within the shell 11 and can be removed and replaced individually on shut down without interfering with the integrity of the shell.

The cooling panels consist of a set of forty-eight panels 31 lining the main cylindrical barrel section 18 of the shell and a set of sixteen panels 32 lining the tapering roof section 19. A first set of four panels 33 line a lower part of the off-gas chamber 26 immediately above the tapering roof section 19. Twenty panels 34 line the section of the off-gas chamber 26 above the first set of four panels 33. Eleven panels 35 line the lid 22 and eight panels 40 line the outlet 23.

The panels of the off-gas chamber and the lowest row of panels in the barrel section are formed from a single layer of pipes, whereas the remaining panels of the barrel section 31 and also of the tapering roof section 19 are formed from a double layer of pipes, disposed one in front of the other relative to the vessel shell 17. The lowest row of panels 31 in the barrel section are located behind the refractory of the hearth and are closest to the molten metal. In the event of significant refractory erosion or spalling there is potential for these panels to contact molten metal and therefore are preferably constructed of copper. The remaining panels in the barrel section and also the off-gas chamber 26 may be constructed of steel.

Figure 3:
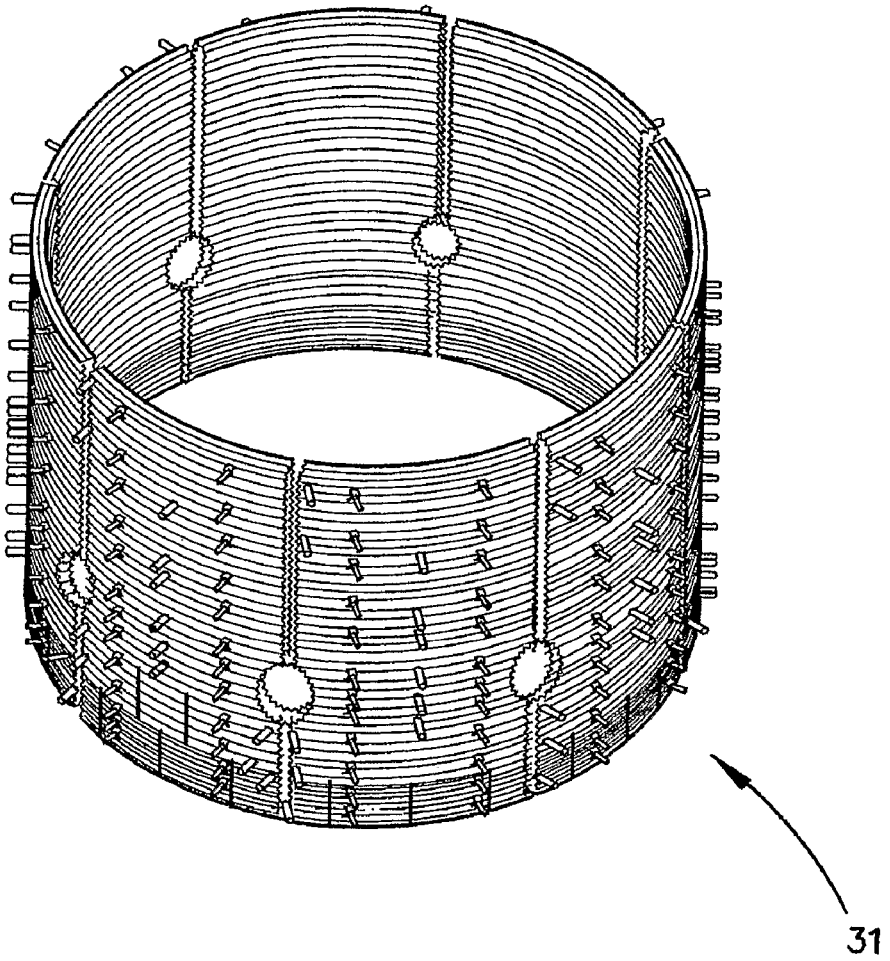
FIG. 3 illustrates the arrangement of cooling panels lining a main cylindrical barrel part of the vessel.
Figure 4:
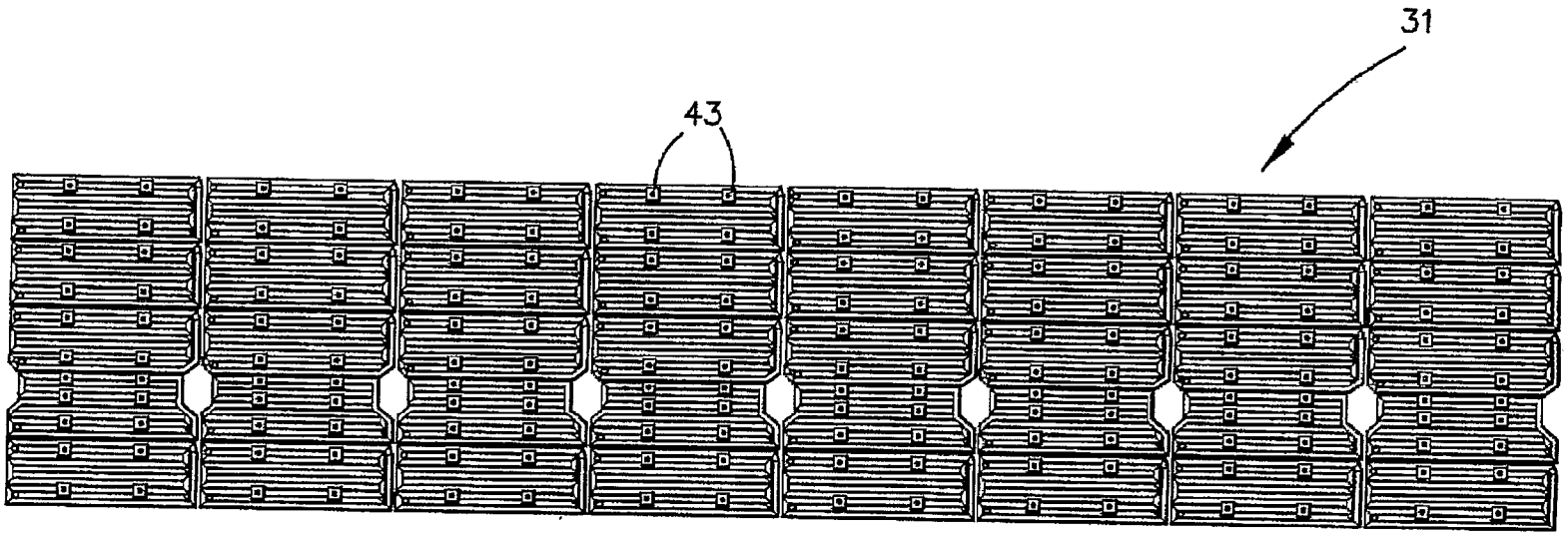
FIG. 4 is a development of the cooling panels shown in FIG. 3.
Figure 5:
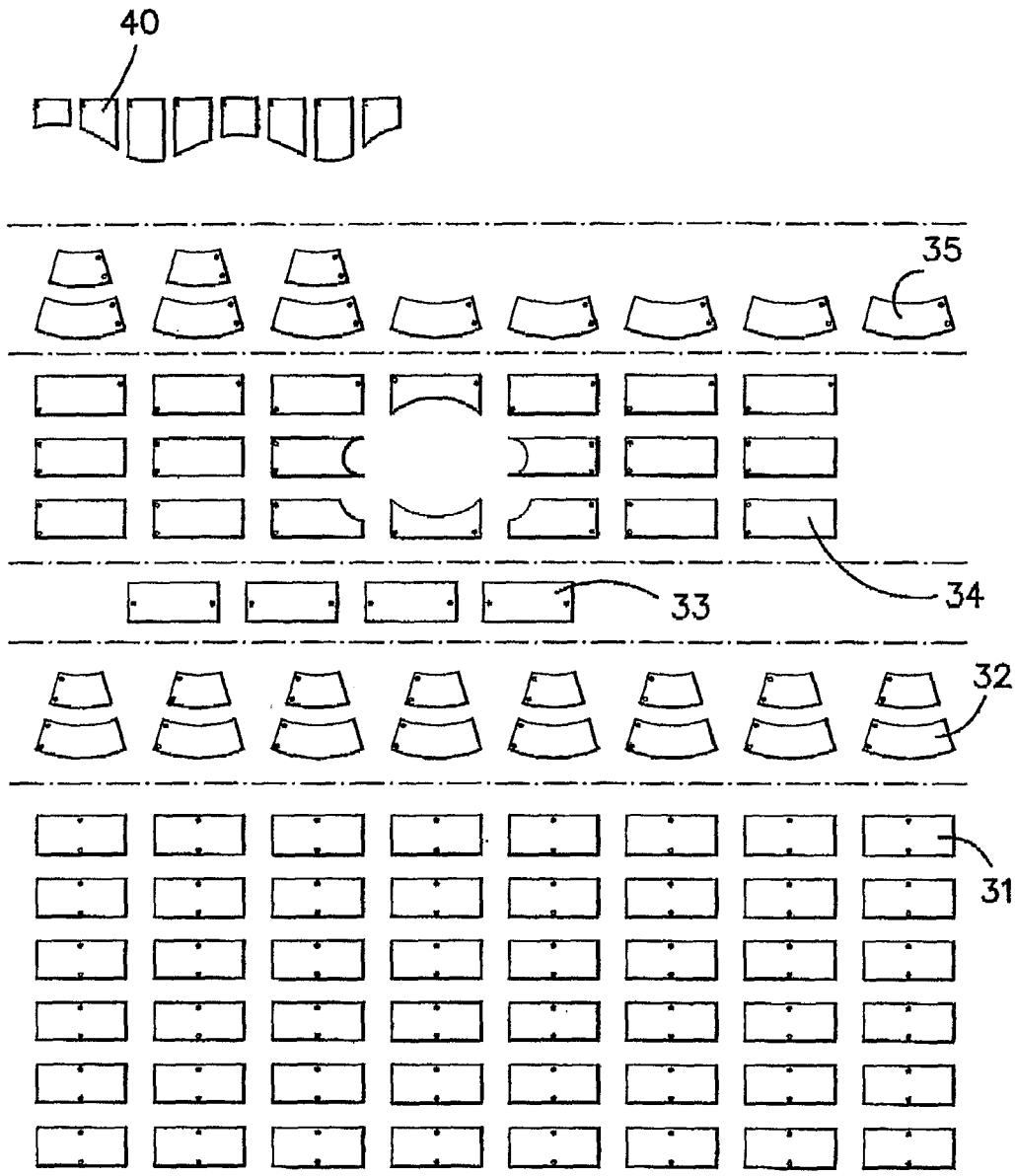
FIG. 5 is a development showing diagrammatically the complete set of cooling panels fitted to the vessel.
Figure 6:
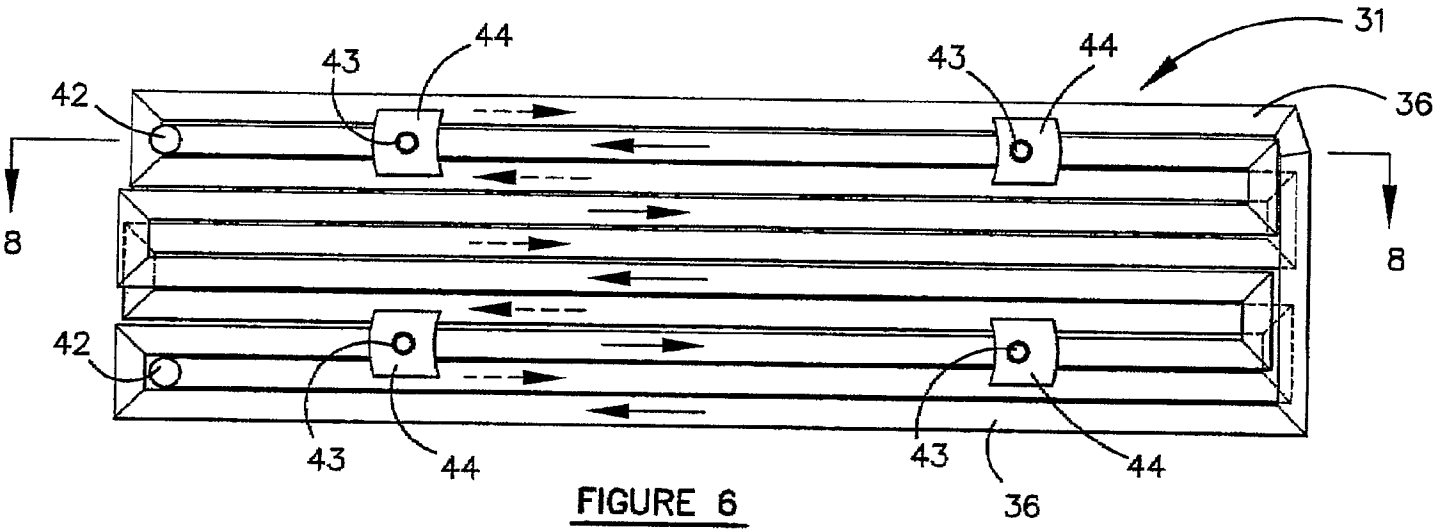
FIG. 6 is an elevation of one of the cooling panels fitted to the cylindrical barrel section of the vessel.
Figure 7:
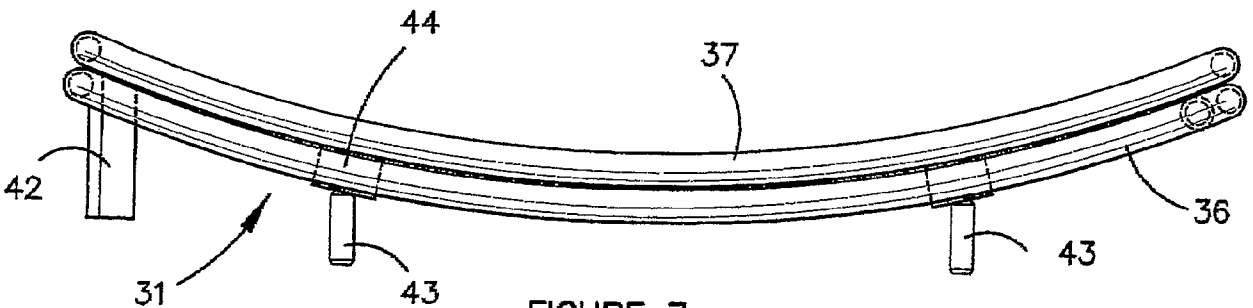
FIG. 7 is a plan of the panel shown in FIG. 7.
Figure 8:
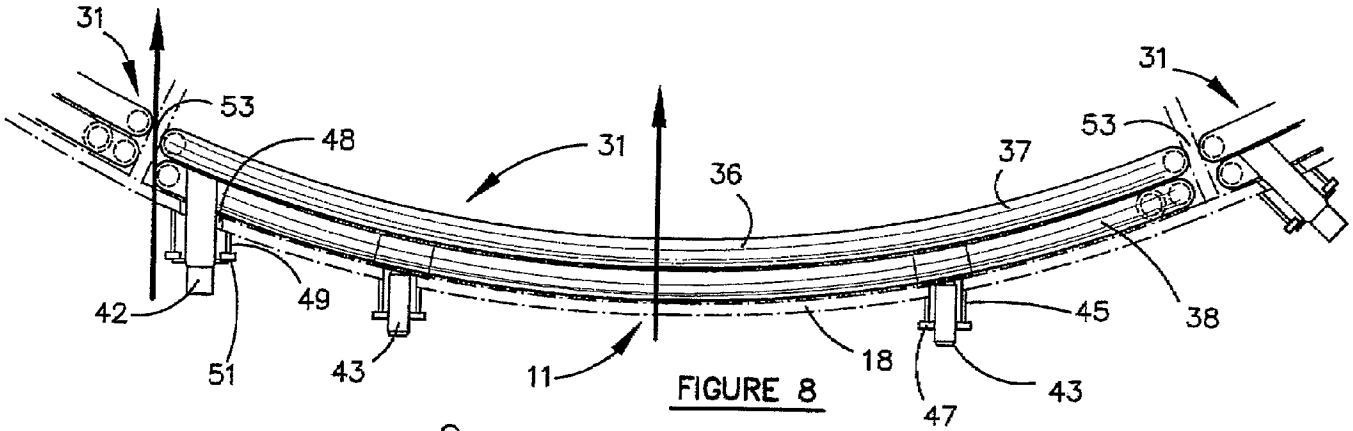
FIG. 8 is a cross-section on the line 8-8 in FIG. 6.
Figure 9:
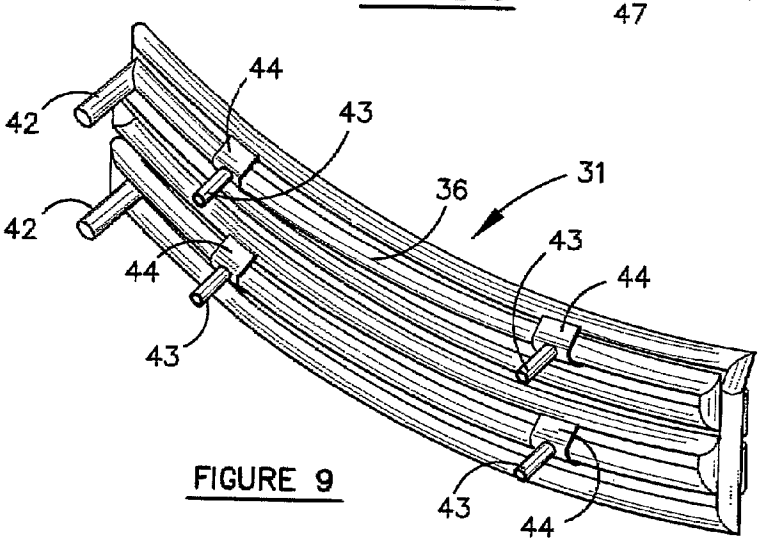
FIG. 9 is a front view of the cooling panel illustrated in FIG. 6.
Figure 10:
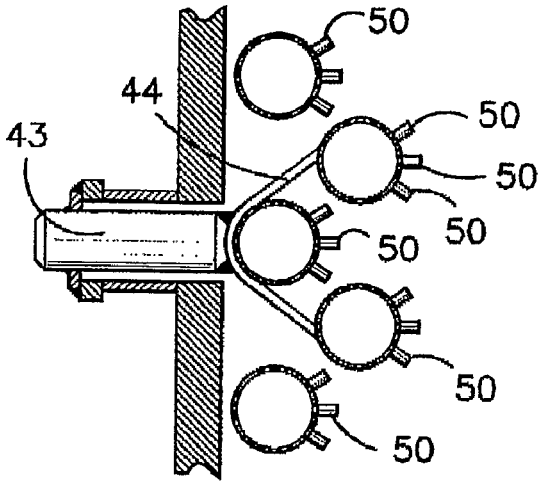
FIG. 10 illustrates a detail of the cooling panel.
Figure 11:
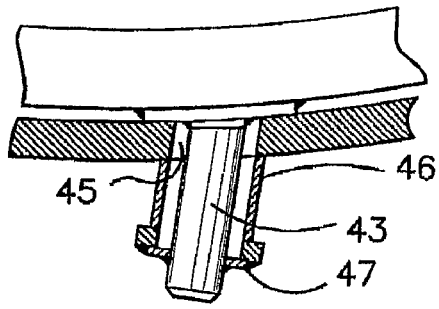
FIGS. 11 and 12 illustrate details of the connection of a cooling panel to the vessel shell.
Figure 12:
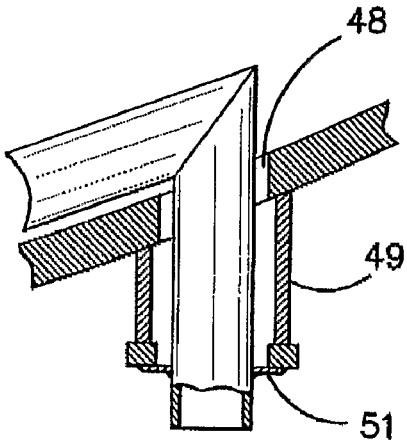
Figure 13:
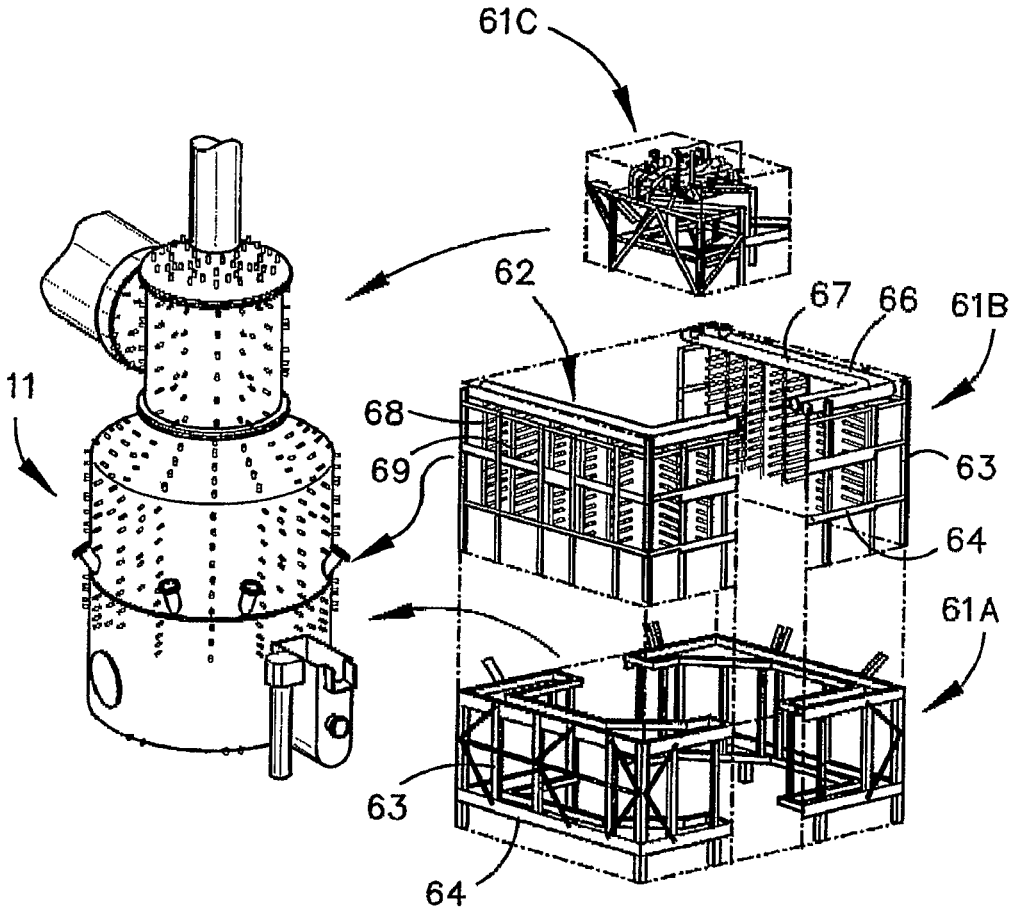
FIG. 13 illustrates a vessel access tower which extends about the direct smelting vessel in a direct smelting plant and which is provided with coolant flow systems for flow of coolant to and from the cooling panels of the vessel and to other equipment fitted to the vessel.
Figure 14:
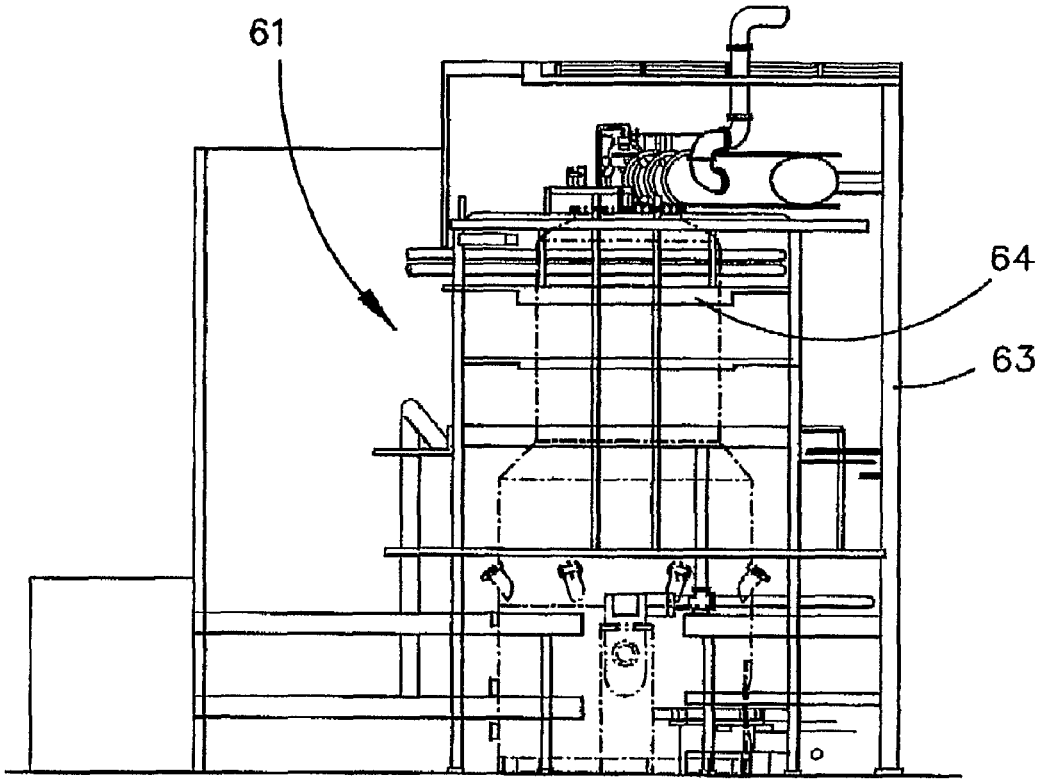
FIG. 14 further illustrates the construction of the vessel access tower.

The construction of panels 31 and the manner in which they are mounted on the main cylindrical barrel 18 of the vessel shell is illustrated in FIGS. 6-12. As shown in FIGS. 3, 4 and 5, these panels are disposed in 6 vertically spaced tiers of arcuate panels spaced circumferentially of the vessel, there being eight individual panels 31 in each tier. Each panel 31 is comprised of a coolant flow tube 36 bent to form inner and outer panel sections 37, 38 of zigzag formation. The inner and outer panel sections 37, 38 are also vertically off-set such that the horizontal pipe segments of one panel section are located intermediate the horizontal pipe segments of the other panel section. Coolant inlet and outlet tubular connectors 42 extend from the inner panel section at preferably one end of each panel, though they may also extend from other sections of, or locations on, the panel.

Panels 31 are of elongate arcuate formation having greater length than height and with a curvature to match the curvature of the main cylindrical barrel section 18 of the shell. As may be seen from FIGS. 3 & 4 a series of apertures 55 are formed within the set of barrel panels 31. These apertures 55 align with the circumferentially spaced tubular mountings 25 and operate to provide clearance sufficient for solids injection lances to penetrate into the interior of the vessel 11. Typically the apertures are shaped so as to accommodate generally cylindrical solids injection lances that extend through the vessel shell 17 and the panels 31 so as to form an angle to a vertical plane tangential to the vessel shell 17 at the centre point of the penetration. The apertures 55 are formed by alignment of two or more panels having, recesses formed along an edge. The recesses may be along vertical or horizontal edges or may be at one or more corners. The tubular mountings 25 are spaced circumferentially of the vessel at a common height. The panels that form apertures 55 are of a length corresponding to the circumferential distance between tubular mountings 25 such that typically the centre line of each lance is aligned with the vertical edge of two or more adjacent panels. This arrangement results in the panels in the region of the solids injection lances having recesses along both vertical edges. These recesses may extend to the upper or lower corner of the panel.

A set of four mounting pins 43 are connected to the zigzag tubular formation of the outer panel section 38 by means of connector straps 44 so as to project laterally outwardly from the panel. Each connector strap 44 is fastened at its ends to adjacent tube segments of the inner panel section and extends between its ends outwardly across a tube segment of the outer panel section in the manner shown most clearly in FIG. 10. The connector straps 44 are generally V-shaped with the root of the V-shape curved to fit snugly about the tube segment of the outer panel section. The pins 43 are welded to the connector straps so as to extend outwardly from the roots of the V-shapes. The connecting straps serve to brace the panels by holding the tube segments securely in spaced apart relationship at multiple locations distributed throughout the panels, resulting in a strong but flexible panel construction.

The mounting pins 43 are extended through openings 45 in the shell 17 and tubular protrusions 46 surrounding the openings 45 and protruding outwardly from the shell 17. The ends of pins 43 project beyond the flanges 57 located at the outer ends of the tubular protrusions 46. The pins 43 are connected to the flanges 57 by welding annular metal discs 47 to the pins 43 and the flanges 57 thus forming connections exteriorly of the shell in a way which seals the openings 45.

In similar fashion the inlet and outlet connectors 42 for the panel project outwardly through openings 48 in the shell 17 and through and beyond tubular protrusions 49 surrounding those openings and protruding outwardly from the shell and connections are made by welding annular discs 51, between the connectors 42 and flanges 59 located on the extremity of the protrusions 49. In this way, each panel 31 is mounted on the shell through the four pins 43 and the coolant connectors 42 at individual connections exteriorly of the shell. The pins and coolant connectors are a clearance fit within the tubular protrusions tubes 46, 49. The protrusions 46, 49, the flanges 57, 59, the discs 47 and the pins 43 are rigid and have sufficient strength to support the load of the panels in a cantilevered manner from the extremity of the protrusions when the panels are operational and hence filled with cooling water and encased in refractory.

The panels 31 are removed by grinding the weld between the pins 43 and the flanges 57 and between the coolant connectors 42 and the flanges 59. In this way the panels are readily removed. The flanges 57, 59 may also be removed by grinding before replacement panels are installed. This method allows the panels to be removed with limited damage to the flanges 57, 59, the protrusions 46, 49 and hence the vessel 11.

The pins 43 and the coolant inlet and outlet connectors 42 are oriented so as to project laterally outwardly from the panel in parallel relationship to one another and so as to be parallel with a central plane extended laterally through the panel radially of the vessel so that the panel can be inserted and removed by bodily movement of the panel inwardly or outwardly of the cylindrical barrel of the vessel.

The gaps 53 between the circumferentially spaced panel 31 must be sufficient to enable the trailing outer edges of a panel being removed to clear the inner edges of the adjacent panels when the panel to be removed is withdrawn inwardly along the direction of the pins 46 and connectors 42. The size of the gaps required is dependant on the length of the arcuate panels and therefore the number of panels extending the circumference of the barrel section 18. In the illustrated embodiment there are eight circumferentially spaced panels in each of the six tiers of panels 31. It has been found that this allows minimal gaps between the panels and ensures proper cooling of refractory material at the gaps. Generally for satisfactory cooling it is necessary to divide each tier into at least six circumferentially spaced panels. Additionally, the arcuate length of an outer panel section may be less than the arcuate length of an inner panel section. Such an arrangement allows the gap 53 between the inner panel section of adjacent panels to be minimised compared with an arrangement where the outer panels section and inner panel section are of the same length.

Refractory retainer pins 50 are butt welded to the coolant tubes of panels 31 so as to project inwardly from the panels and act as anchors for the refractory material sprayed out the panels. Pins 50 may be arranged in groups of these pins radiating outwardly from the respective tube and arranged at regular spacing along the tube throughout the panel.

The panels 33 and 34, being fitted to cylindrically curved sections of the vessel, are formed and mounted in the same fashion as the panels 31 as described above, but some of the panels 34 are shaped in the manner shown in FIG. 5 so as to fit around the offgas outlet 23.

The panels 32 and 35, being fitted to tapered sections of the shell, are generally conically curved in the manner shown in the illustrated development of FIG. 5 except for this variance in shape. However, these panels are also formed and mounted to the shell in similar fashion to the panels 31, each being fitted with mounting pins projecting laterally outwardly from the panel and a pair of inlet/outlet coolant connectors at opposite ends of the panels, the pins and connectors being extended through openings in the shell and connected to tubes projecting laterally outwardly from the shell to form connections exteriorly of the shell which seal the openings and provide a secure mounting for the panels while permitting some freedom of movement of the panels.

Figure 15:
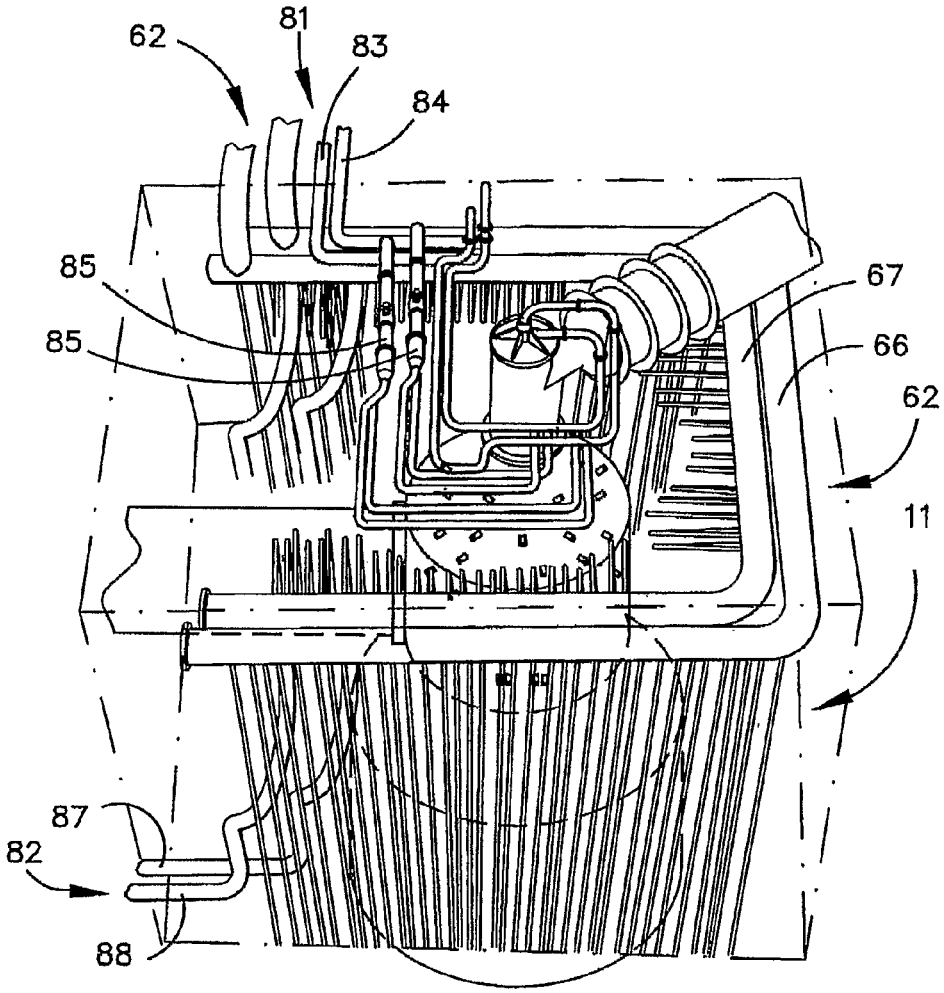
FIG. 15 illustrates the vessel and a part of the coolant flow systems on the access tower.
Figure 16:
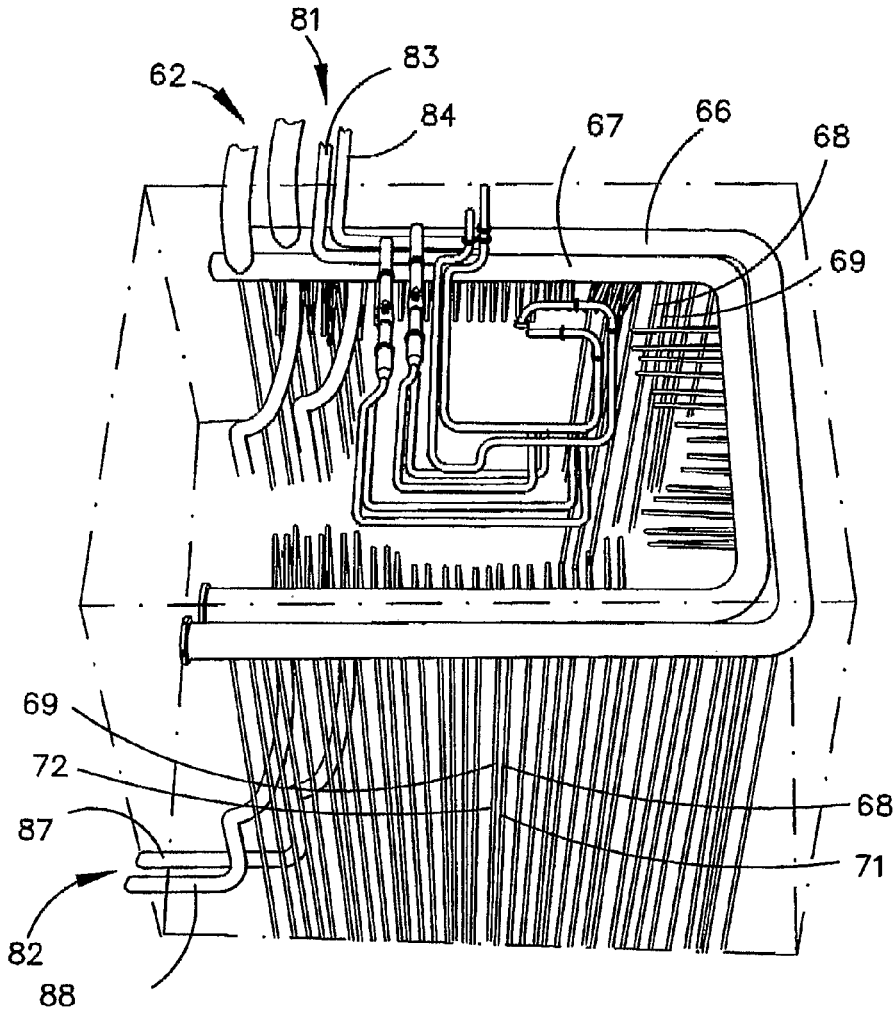
FIG. 16 illustrates the coolant flow systems with the vessel removed.
Figure 17A:
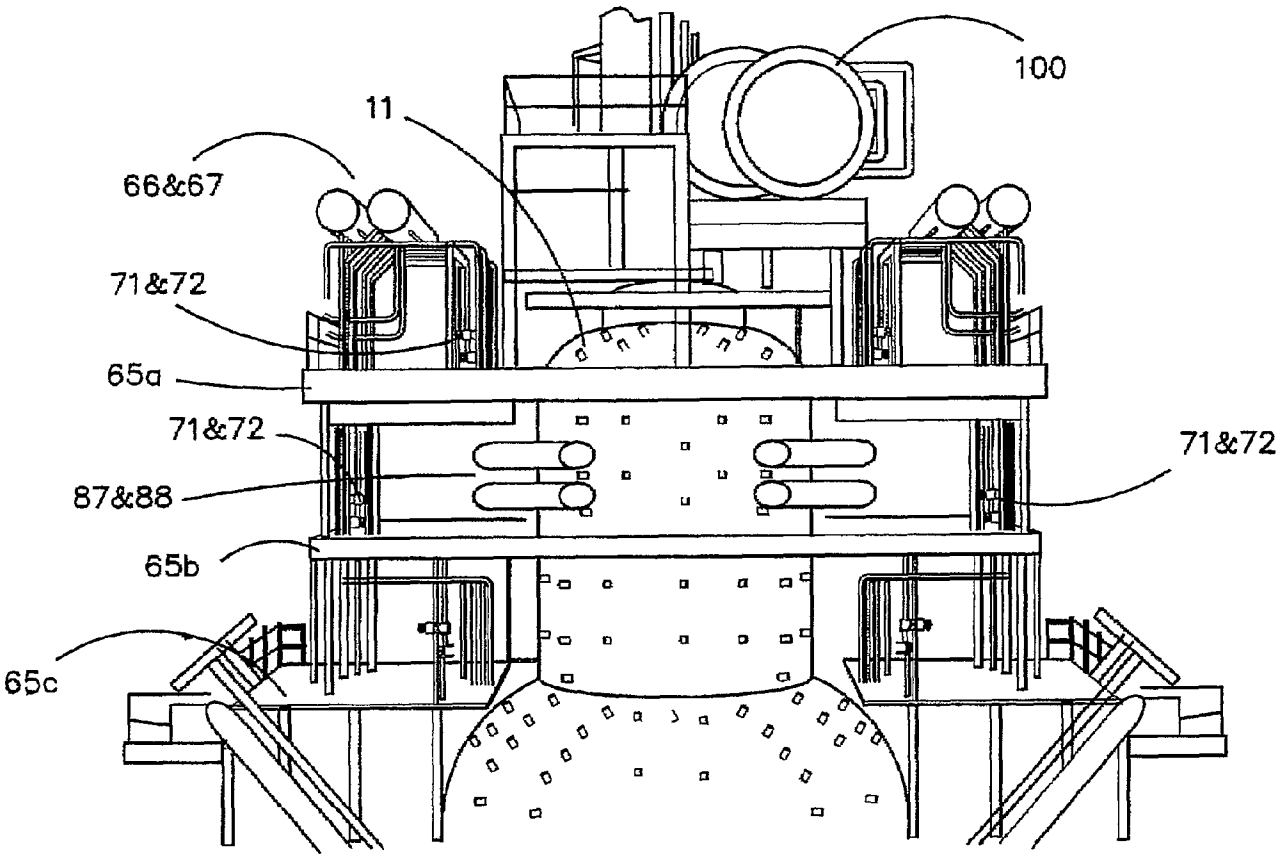
FIGS. 17*a* and 17*b* provide a pictorial representation of the vessel in combination with the access tower and the coolant flows systems
Figure 17B:
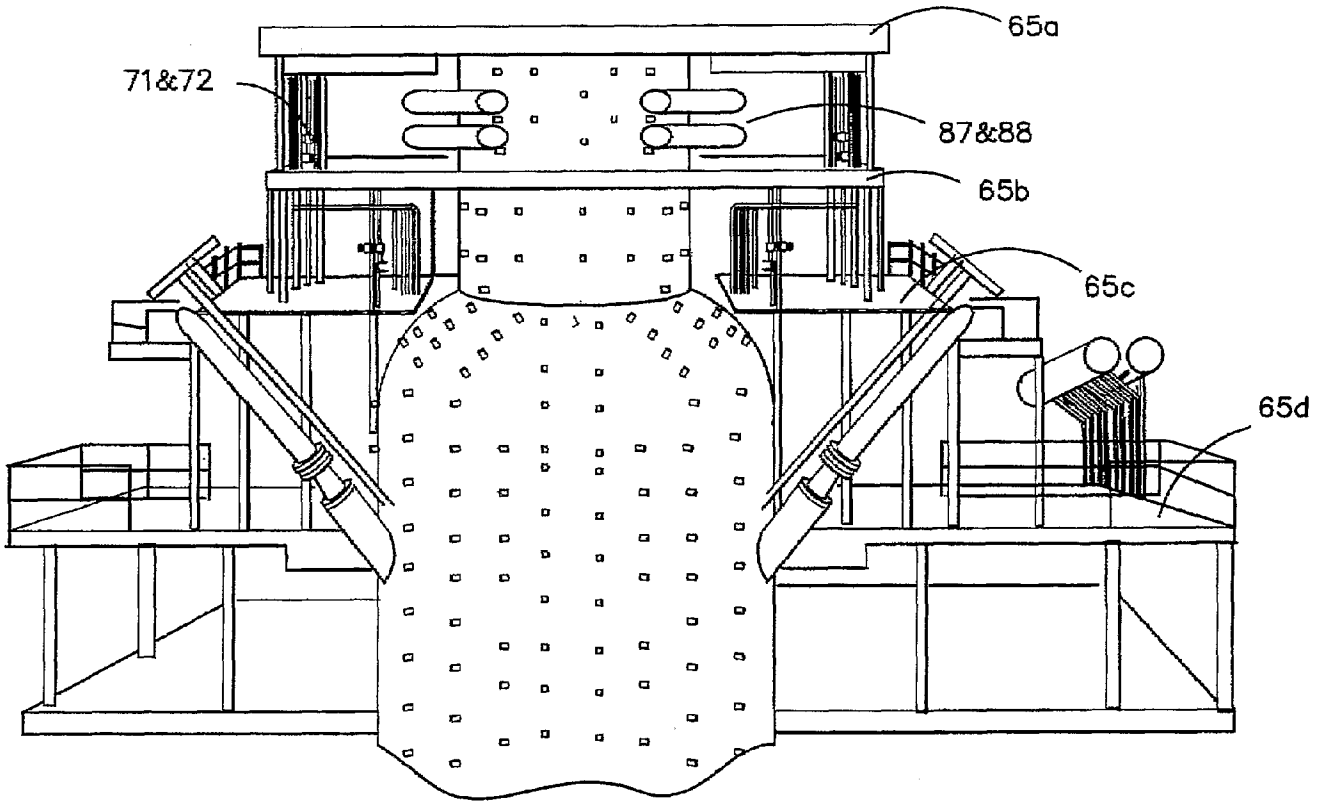

FIGS. 13 to 16, together with FIGS. 17*a* and 17*b* illustrate a vessel access tower 61 designed to fit around the vessel 11 and fitted with a coolant flow system 62 to provide for flow of cooling water to and from the cooling panels 31, 32, 33, 34 and 35 within the vessel and two separate coolant flow systems 81, 82 for flow of cooling water to the coolant flow passage of the hot gas injection lance at the upper end of the vessel and to the coolant flow passageway of the solids injection lances spaced circumferentially around the vessel.

Tower 61 is formed in three modules 61A, 61B and 61C which are installed one on top of the other and welded together on installation at the direct smelting plant site. The tower is comprised of a structural framework of columns 63 and beams 64 which carry the coolant flow systems 62, 81 and 82 and walkways 65 providing access to the vessel and the coolant flow systems.

The coolant flow system 62 includes water supply and return piping comprising large diameter main supply and return pipes 66, 67 mounted on an upper part of tower 61 to extend around the upper end of vessel 11, a first series of vertical dropper pipes 68 of relatively small diameter connected to the main water supply pipe 66 and extending downwardly to connections with the water inlet connectors for the respective cooling panels of the vessel, and a second series of smaller diameter vertical pipes 69 connected at their upper ends to the main return pipe 67 and at their lower ends to individual outlet connectors for the cooling panels in the vessel. Thus the vertical pipes 68 provide for separate flows of water from the main supply pipe to individual panels and the pipes 69 provide for independent return flow of water from the outlets of the individual panels. The lower ends of the vertical pipes 68, 69 are connected to the respective panel inlet and outlet connectors via horizontal pipe ends which extend inwardly to the respective connectors and are connected to them via flexible couplings.

The vertical pipes 68 supplying individual water flows to the panels are provided with individual flow control valves 71 and the vertical pipes 61 providing individual return flows from the panels are provided with individual flow control valves 72 so that both the input and output flows of each panel of each cooling panel can be adjusted. This allows for fine tuning of the flows through all of the panels and control of cooling throughout the vessel.

The vertical water flow pipes 68, 69 are arranged in adjacent pairs in a sheet-like array around the tower 61 and the flow control valves 71, 72 are grouped in arrays extending generally horizontally around the tower in the vicinity of horizontal walkways on the tower so that they are readily accessible by walking around the walkways. The valves are arranged sequentially around the vessel in the same order as the respective cooling panels to which they relate so that the relationship between the valves and the related part of the vessel is readily apparent.

Coolant flow system 81 provides for flow of water to and from the coolant flow passageway the hot gas injection lance at the upper end of the vessel. As seen in FIGS. 15 and 16, coolant flow system 81 includes main supply and return pipes 83, 84 mounted on an upper part of tower 61 and which are connected by smaller branch pipes 85 to respective connections on the hot air injection lance assembly 86.

Coolant flow system 82 provides for flow of water to and from the coolant flow passage of the solids injection lances spaced circumferentially around the vessel. It may also provide cooling water for cooling the slag notch of the vessel. As seen in FIGS. 15 and 16, coolant flow system 82, comprises main supply and return pipes 87, 88 which are connected by branch pipes to the respective connectors on the solids injection lances and to cooling water passageways at the slag notch.

FIGS. 17*a* and 17*b* provide a pictorial representation of vessel 11 in combination with the access tower 61 and the coolant flow systems 62, 81 and 82. In particular, off-gas chamber 26, roof section 19 and an upper portion of barrel section 18 of vessel 11 may be seen along with a portion of the hot gas injection lance and a hot gas supply main 100, that supplies hot gas to the hot gas injection lance.

The access tower 61 comprises an inner periphery that is located adjacent the vessel 11 and an external periphery that is laterally displaced from the inner periphery. A number of walkways 65 extend between the inner periphery and the external periphery and provide personnel with access to the vessel 11, equipment located on the vessel 11, the coolant flow systems 61 and 82 and flow control valves 71 & 72. Additional walkways are provided above the roof section 19 of the vessel and provide access to the hot gas injection lance, its associated cooling system 82 and the hot gas supply main 100.

The walkways 65 extending between the inner and outer peripheries of the access tower 61 include an off-gas chamber control and monitoring walkway 65*a*, a barrel control and monitoring walkway 65*b* and a lance control and monitoring walkway 65*c*. Cooling to the off-gas chamber 26 of the vessel 11 is monitored and controlled from the off-gas chamber control and monitoring walkway 65*a*. Cooling to the barrel section 18 of the vessel 11 is monitored and controlled from the barrel control and monitoring walkway 65*b*. Cooling to the lances and ancillary equipment is controlled from the lance control and monitoring walkway 65*c*.

The off-gas chamber monitoring and control walkway 65*a* is located adjacent the roof section 19 of the off-gas chamber 26. The main supply and return pipes 66 & 67 are located above both the roof section 19 and the off-gas chamber control and monitoring walkway 65*a*. The barrel control and monitoring walkway 65*b* is the walkway immediately below the off-gas chamber control and monitoring walkway 65*a*. The lance control and monitoring walkway 65*c* is the walkway immediately below the barrel control and monitoring walkway 65*b*. Additional walkways are located below the lance control and monitoring walkway 65*c*, such as a lance access walkway 65*d* that allows personnel to access the solids injection lances along with a cast house floor 65*e* and an end tap floor 65*f*.

A raw materials conveying region is located adjacent the solids injection lances and the inner periphery of the access tower. It extends between the lance control and access walkway 65*c* and the barrel control and access walkway 65*b*.

Main supply and return pipes 66 and 67 of coolant flow system 62 operate as header pipes and, as detailed above, are located above the roof section 19 of the vessel 11. Main supply and return pipes 87, 88 of coolant flow system 82 also operate as header pipes and are typically located adjacent the inner periphery of access tower 61 around a mid section of off-gas chamber 26, between the barrel control and monitoring walkway 65*b* and the off-gas chamber control and monitoring walkway 65*a*.

The coolant flow system 62 supplies cooling water to the water cooled panels depicted in FIG. 5 that are distributed on the shell of the vessel 11 between a lower region of the vessel adjacent the hearth and the roof section 19 of the vessel 11. The coolant flow system 82 supplies cooling water to solids injection lances that supply raw materials to the vessel 11 during operation and also to other ancillary equipment such as a slag notch through which slag is tapped during operation. The coolant flow system 62 for the water cooled panels operates at a different cooling water pressure to the coolant flow system 82 for the solids injection lances and the ancillary equipment. The headers for the coolant flow system 82 for the solids injection lances and ancillary equipment are located below the headers for the coolant flow system 62 for the water cooled panels.

Water flow pipes 68, 69 of coolant flow system 62 that extend between the main supply and return pipes 66 & 67 and the water cooled panels are, at least in part, distributed across the external periphery of the access tower. Water flow pipes of the coolant flow system 82 that extend between the main supply and return pipes 87 & 88 and the water cooled injection lances and ancillary equipment are primarily distributed across the inner periphery of the access tower.

As can be seen from FIG. 5, a typical embodiment provides in the order of 100 water cooled panels supported by vessel 11. This results in a large number of coolant flow pipes distributed across the access tower 61 between the main supply and return pipes 66 & 67 and the water cooled panels.

Water flow pipes 68 & 69 are distributed, at least in part, across the external periphery of the access tower. In order to connect with the water cooled panels, the coolant flow pipes 68 & 69 are routed from the external periphery to the inner periphery in a staged manner. For example, only those water flow pipes that connect to water cooled panels located in the upper region of the vessel (such as the off-gas chamber 26) extend directly from main supply and return pipes 66 & 67. The remainder extend across the external periphery of the access tower 61 before being routed back to the inner periphery. This reduces over crowding of pipe work adjacent the inner periphery of the access tower, at least in the vicinity of the upper region of the vessel 11.

The pipes that connect to water cooled panels located on the middle and lower regions of the vessel extend from the main supply and return pipes 66 & 67 along the external periphery of the access tower 61. In this regard they extend across the external periphery substantially parallel to the upper region of the vessel 11 and hence substantially parallel to the pipes extending along the inner periphery of the access tower 61 adjacent the upper region of the vessel and connecting to water cooled panels located in this upper region. These pipes on the external periphery are then routed to the inner periphery from a position on the access tower that is in the vicinity of the middle region of the vessel. Pipes connecting to water cooled panels located below the middle section of the vessel may also extend along the external periphery of the access tower, substantially parallel to the upper and middle section of the vessel, and be routed to the inner periphery of the access tower from a position in the vicinity of the lower region.

Thus the water flow pipes extending to the upper sections of the vessel 11 and the water flow pipes extending to the middle and lower sections of the vessel 11, extend in a generally parallel manner along the inner and outer periphery of the access tower and are laterally spaced by walkways, such as the off-gas chamber control and monitoring walkway 65*a*. This arrangement typically allows that only those pipes that are to be connected to water cooled panels located in a particular area of the vessel 11 (such as the off-gas chamber 26) are located at the inner periphery of the access tower in the particular area of concern. Pipes that extend past this area and that are connected to a lower area of the vessel 11 are located on the external periphery. This arrangement for the staged routing of pipes to the inner periphery of the access tower 61 helps reduce over crowding of coolant flow pipes adjacent the upper areas of the vessel 11 which would otherwise have all or a large portion of the coolant flow pipes extending past their surface if all of the water flow pipes were routed along the inner periphery of the access tower.

Typically the pipes are routed in groups from the external periphery to the inner periphery of the access tower adjacent the underneath surface of the walkways. For example, pipes for the upper section of the barrel may be routed underneath the barrel control and monitoring platform 65*b*, whereas pipes for a lower section of the vessel may be routed underneath the lance control and monitoring walkway 65*c*, the lance access walkway 65*d* and possibly the cast house floor 65*e*. This ensures the walkways provide clear access for personnel that is substantially free from water supply pipes.

Alternate embodiments may locate an additional set of header pipes between the lance access walkway 65*d* and the lance control and monitoring walkway 65*c*. The header pipes are raised off of the lance access walkway 65*d* toward the under surface of the lance monitoring and control walkway 65*c*. These header pipes service the water cooled panels located in the lower region in the vessel 11 adjacent the hearth. Typically they service the lower two rows of water cooled panels.

These additional header pipes are located at an external periphery of the lance access walkway 65*d* and the water flow pipes that extend off of these headers extend vertically to below the lance access walkway 65*d* and then are routed either underneath the lance access walkway 65*d* to their connection point with a water cooled panel or extend to below the cast house floor from where they are routed to their connection with a water cooled panel. Control valves 71 & 72 are located on the vertical section of these pipes adjacent the lance access walkway 65*d* so that the lower rows of the water cooled panels are controlled from a single location.

As detailed above, water flow pipes of the coolant flow system 62 that extend between the main supply and return pipes 66 & 67 and the water cooled panels are divided into two groups. A first group extends horizontally from the headers 66 & 67 toward the inner periphery of the access tower 61 and then drop vertically, adjacent the inner periphery of the access tower 61, in order to connect to the water cooled panels located on the off-gas chamber 26. A large portion of these pipes extend below the off-gas chamber control and monitoring walkway 65*a* and are then routed adjacent the underneath surface of this walkway to a location aligned with the required water cooled panel. Once aligned, the pipes extend vertically again from the underneath surface of the walkway 65*a* to the location on the off-gas chamber of the inlet or outlet pipe of the water cooled panel of interest.

Control valves 71 & 72 and other monitoring and control equipment for the water cooled panels located in the upper region of the vessel are typically located at a position above walkway 65*a* (i.e. on the vertical sections of the water flow pipes servicing the water cooled panels of the off-gas chamber). This location of the control valves 71 & 72 enables personnel standing on platform 65*a* to monitor and control the cooling of the off-gas chamber from a single walkway.

The second group of water flow pipes 68 & 69 of the coolant flow system 62 for the water cooled panels extend from the main supply and return pipes 66 & 67 to the external periphery of the access tower 61. This second group forms a sheet like array of pipes that extends vertically down at least a part of the external periphery of the access tower 61. In order to connect to the water cooled panels, these pipes also extend between the external periphery and the inner periphery of the access tower 61 in a horizontal manner. In this regard each pipe extends underneath one of the various walkways 65 and is routed, adjacent the underneath surface of the walkway, toward the inner periphery of the access tower 61 and is aligned with the cooling panel of interest. For example, pipes that are to be connected to an upper section of the barrel 18 of the vessel typically extend underneath the barrel control and monitoring walkway 65*b* and pipes to be connected to a lower section of the barrel 18 of the vessel may extend under the lance control and monitoring walkway 65*c*. Underneath the walkways the pipes are routed to a location aligned with the required water cooled panel. Once aligned, the pipes extend vertically again, typically from adjacent the underneath surface of the walkway to the location on the vessel 11 of the inlet or outlet of the water cooled panel of interest.

A typical embodiment has eight lances and one slag notch and so the number of water flow pipes distributed from the main supply pipes 87 & 88 across the inner periphery of the vessel is substantially less than the number of water flow pipes with the water cooled panels. Accordingly, location of the main supply pipes 87 & 88 adjacent the inner periphery of the access tower does not lead to over crowding of the surface of the vessel by coolant flow pipes.

The raw materials conveying region is located adjacent the solids injection lances. Raw materials conveying apparatus extend laterally through the raw materials conveying region, from adjacent the external periphery of the access tower to connect with the solids injection lances adjacent the inner periphery of the access tower.

The water flow pipes for the coolant panels of the vessel adjacent the raw materials conveying region are distributed across the inner periphery of the access tower. Similarly the water flow pipes for the solids lances are also distributed across the inner periphery of the access tower. Thus the external periphery of the access tower adjacent the raw materials conveying region is substantially free of water flow pipes. This provides for relatively unimpeded access to the raw materials conveying apparatus and the solids injection lances.

The supply and return pipes for any particular piece of water cooled equipment are typically located adjacent each other. This allows the control valves 71, 72 and other control or monitoring devices for each piece of water cooled equipment to be located in close proximity to each other for ease of operation. Where the supply and return pipes extend down the external periphery of the tower, the control valves 71 & 72 and other control or monitoring equipment are typically located on the vertical section of the pipes adjacent one of the walkways 65. This enables the control valves and other monitoring equipment to be located on the external periphery of the access tower 61 for access by personnel located on the walkway of interest. Where the supply and return pipes are associated with main supply and return pipes 87 & 88 for the solids injection lances and the ancillary equipment, the control valves and other control or monitoring equipment are located adjacent the inner periphery of tower 61 on the lance control and monitoring walkway 65*c*

This arrangement allows the control valves and other monitoring equipment for the water cooled equipment located in specific regions of the vessel (such as the off-gas chamber 26, the barrel 18) or arranged in specific groups or separate cooling water circuits (such as the solids injection lances) to be grouped together in close proximity for ease of operation. For example, the control valves and other monitoring equipment for the off-gas chamber 26 are located adjacent to and are accessible from the off-gas control and monitoring platform 65*a*. As these water flow pipes extend from the main supply and return pipes 66 & 67 directly along the inner periphery of the access tower, the control valve and other monitoring equipment on the off-gas control and monitoring platform are located adjacent the inner periphery of the access tower 61. The control valves and other monitoring equipment for the water cooled panels located on the barrel 18 are located adjacent to and are accessible from the barrel control and monitoring platform 65*b*. These water flow pipes extend along the external periphery of the access tower before extending underneath the barrel control and monitoring platform 65*b* (or a platform lower down on the access tower) and the control valves and other monitoring equipment are located adjacent the external periphery of the access tower 61. The control valves and other monitoring equipment for the solids injection lances and other ancillary equipment are located adjacent to and are accessible from the lance control and monitoring platform 65*c*. The water flow pipes for the solids injection lances and other ancillary equipment are distributed across the inner periphery of the access tower. Accordingly the control valves and other monitoring equipment for solids injection lances and other ancillary equipment are located adjacent the inner periphery of the access tower.

Whilst the embodiment detailed above provides control valves and other monitoring equipment for different regions of the vessel on different walkways, it is possible for control valves for different regions to be located on the same walkway. For example, the control valves and monitoring equipment for off-gas chamber 26 and barrel 18 may be located adjacent the same walkway as these control valves would be located on the inner periphery and the external periphery respectively.

The illustrated equipment has been advanced by way of example only. The physical construction of the vessel and the cooling panels could be varied as could the detailed construction of the coolant supply system and the manner in which it is supported about the vessel. It is to be understood that such variations can be made without departing from the scope of the appended claims.

The invention claimed is:

1. A metallurgical processing installation comprising:

(a) a fixed hollow metallurgical vessel within which to perform direct smelting of a metalliferous feed material to discharge molten metal continuously;

(b) a plurality of cooling panels forming an internal lining for at least an upper part of the vessel, each panel having an internal passage for flow of coolant therethrough;

(c) coolant inlet and outlet connectors for the panels at locations distributed around the exterior of the vessel;

(d) a coolant flow system for flow of coolant to and from the coolant inlet and outlet connectors, which flow system comprises a supply pipe and a return pipe extending generally horizontally at least partially around the vessel, a first series of upright smaller pipes connected to the supply pipe and to the coolant inlet connectors, and a second series of upright pipes connected to the return pipe and to the coolant outlet connectors; and (e) a tower structure at least partially surrounding the vessel on which the coolant flow system is supported.

2. An installation as claimed in claim 1, wherein the supply pipe and the return pipe are each of generally U shaped configuration and are disposed generally about an upper end of the vessel.

3. An installation as claimed in claim 1, wherein the first and second series of upright pipes are connected to the coolant inlet and outlet connectors via respective individual inlet and outlet valves allowing for adjustment of the coolant flow to and from the panels individually.

4. An installation as claimed in claim 1, wherein the connections to the coolant inlet and outlet connectors are made by flexible couplings.

5. An installation as claimed in claim 1, wherein the tower structure is comprised of a structural frame work of interconnecting columns and beams and has walkways for access to at least one of the vessel or the coolant flow system.

6. An installation as claimed in claim 1, wherein the supply pipe and the return pipe are both supported on an upper part of the tower structure and the first and second series of smaller pipes extend downwardly therefrom.

7. An installation as claimed in claim 1, wherein the first and second series of upright pipes are connected to the coolant inlet and outlet connectors via respective individual inlet and outlet flow control valves allowing for adjustment of the coolant flow to and from the panels individually and the flow control valves are grouped in arrays extending generally horizontally around the tower structure in the vicinity of horizontal walkways on the tower structure so that the flow control valves are accessible by walking around the walkways.

8. An installation as claimed in claim 7, wherein the flow control valves are arranged sequentially around the vessel in the same order as the respective cooling panels to which the flow control valves relate.

9. An installation as claimed in claim 7, wherein the first and second series of upright pipes are arranged in adjacent pairs in a sheet-like array around the tower structure.

10. An installation as claimed in any of claims 1-4 or 5-9, wherein the metallurgical vessel is fitted with a hot gas injection lance for injecting hot gas downwardly in to an upper part of the vessel, which lance is provided with coolant flow passages, and the tower structure also supports a gas lance coolant flow system for flow of coolant to and from the coolant flow passages of the hot gas injection lance.

11. An installation as claimed in claim 10, wherein the gas lance coolant flow system comprises main supply and return pipes mounted on an upper part of the tower structure and connected by smaller branch pipes to the coolant flow passages of the hot gas injection lance.

12. An installation as claimed in any of claims 1-4 or 5-9, wherein the metallurgical vessel is fitted with a series of solids injection lances for injection of solid metalliferous feed material into a lower part of the vessel, which lances are provided with coolant flow passages, and the tower structure supports a solids lance coolant flow system for flow of coolant to and from the coolant flow passages of the solids injection lances.

13. An installation as claimed in claim 12, wherein the solids lance coolant flow system comprises main supply and return pipes mounted on the tower structure and branch pipes connected to the coolant flow passages of the solids injection lances.

14. An installation as claimed in any of claims 1-4 or 5-9, wherein the tower structure comprises an inner periphery adjacent the vessel and an external periphery laterally displaced from the inner periphery and wherein a first set of upright pipes, comprising a portion of said first and second series of upright pipes, is distributed along said inner periphery and a second set of upright pipes, comprising a further portion of said first and second series of upright pipes, is distributed about at least part of the external periphery of the tower structure.

15. The installation as claimed in claim 14 further comprising at least one platform extending between said inner periphery and said external periphery and said platform located between a lower region of the vessel and an upper region of the vessel and said platform providing access for personnel to the first and second set of upright pipes and wherein said second set of upright pipes extend from said external periphery underneath the at least one platform and connect to the coolant inlet connectors and the coolant outlet connectors.

16. The installation as claimed in claim 14, further comprising a plurality of platforms located at a plurality of levels between a lower region and an upper region of said vessel and individual pipes of said second set of upright pipes may extend underneath said platforms from the external periphery to thereby connect with the inlet and outlet connectors of said panels located at varying heights on said vessel between said lower region and said upper region.

17. The installation as claimed in claim 14, wherein the first set of upright pipes extend along said inner periphery and connect to the inlet and outlet connectors of said panels located substantially in an upper region of said vessel and said second set may extend along at least a portion of said external periphery and connect to the inlet and outlet connectors of said panels located in a substantially lower region of said vessel.

18. The installation as claimed in claim 16, wherein pipes of said second set of upright pipes extend from said external periphery underneath one or more said platforms.

19. The installation as claimed in claim 14, wherein pipes from the second set of upright pipes extend from the external periphery to the inner periphery of the tower structure adjacent an underneath surface of a first platform and at the inner periphery extend downwardly to the inlet and outlet connectors located on said vessel at points below said first platform.

20. The installation as claimed in claim 19 wherein pipes from the second set of uprights pipes extend from the external periphery to the inner periphery of the tower structure adjacent an underneath surface of a second platform located below the first platform and at the inner periphery extend downwardly to the inlet and outlet connectors located on said vessel at points below said second platform.

21. An installation as claimed in any one of claims 7 to 9 wherein:

a first set of upright pipes, comprising a portion of said first and second series of upright pipes are connected to the inlet and outlet connectors of the panels located in a first region of said vessel such that control valves for the panels located in said first region are located in a first group of control valves; and a second set of upright pipes, comprising a further portion of said first and second series of upright pipes are connected to the inlet and outlet connectors of the panels located in a second region of said vessel such that control valves for the panels located in said second region are located in a second group of control valves.

22. An installation as claimed in claim 21 wherein the tower structure has an inner periphery located adjacent said vessel and an external periphery laterally displaced from said inner periphery by at least one walkway providing access for personnel to said tower structure and said first group of control valves and said second group of control valves are located adjacent said at least one walkway whereby said first group of control valves and said second group of control valves are accessible from said platform by personnel.

23. An installation as claimed in claim 22 wherein one of said first or second group of control valves are located adjacent said inner periphery and the other of said first or second group of control valves are located adjacent said external periphery.

24. An installation as claimed in claim 22, further comprising at least two walkways located one above the other and one of said first or second group of control valves are located adjacent said first walkway and the other of said first or second group of control valves are located adjacent the second walkway.

25. An installation as claimed in claim 12, wherein said tower structure comprises an inner periphery adjacent said vessel and an external periphery laterally displaced from said vessel and the solids lance coolant flow system is located adjacent said inner periphery and branch pipes connected to said coolant flow system are distributed across said inner periphery of said tower structure.

26. An installation as claimed in claim 12, wherein said tower structure comprises a raw materials conveying region adjacent an inner periphery of said tower structure, raw materials conveying apparatus located in said raw materials conveying region and connected to said lances and extending laterally away from said vessel toward an external periphery of said tower structure, said first and second series of said upright pipes distributed about said inner periphery of said tower structure adjacent said raw materials conveying region.

* * * * *

UNITED STATES PATENT AND TRADEMARK OFFICE

CERTIFICATE OF CORRECTION

PATENT NO. : 7,947,217 B2
APPLICATION NO. : 11/587642
DATED : May 24, 2011
INVENTOR(S) : Neil John Goodman et al.

It is certified that error appears in the above-identified patent and that said Letters Patent is hereby corrected as shown below:

Claim 20, col. 14, line 28, “uprights pipes” should read --upright pipes--.

Signed and Sealed this
Nineteenth Day of June, 2012

David J. Kappos

David J. Kappos
*Director of the United States Patent and Trademark Office*